US009371673B2

(12) United States Patent
Nichol

(10) Patent No.: US 9,371,673 B2
(45) Date of Patent: Jun. 21, 2016

(54) DEADBOLT LOCK

(71) Applicant: John Nichol, Oshawa (CA)

(72) Inventor: John Nichol, Oshawa (CA)

( * ) Notice: Subject to any disclaimer, the term of this patent is extended or adjusted under 35 U.S.C. 154(b) by 87 days.

(21) Appl. No.: 13/998,319

(22) Filed: Oct. 21, 2013

(65) Prior Publication Data

US 2014/0110954 A1 Apr. 24, 2014

(30) Foreign Application Priority Data

Oct. 19, 2012 (CA) ..... 2793264

(51) Int. Cl.

| | |
|---|---|
| ***E05B 13/00*** | (2006.01) |
| ***E05C 19/00*** | (2006.01) |
| ***E05B 13/04*** | (2006.01) |
| *E05B 15/12* | (2006.01) |
| *E05C 1/04* | (2006.01) |

(52) U.S. Cl.

CPC ..... *E05C 19/00* (2013.01); *E05B 13/00* (2013.01); *E05B 13/002* (2013.01); *E05B 13/04* (2013.01); *E05B 17/2023* (2013.01); *E05C 1/04* (2013.01); *Y10T 292/304* (2015.04)

(58) Field of Classification Search

CPC ..... E05B 13/00; E05B 13/002; E05B 13/004; E05B 17/2023; E05C 1/04; E05C 19/00; E05C 19/18

USPC ..... 70/14, 202, 211, 416, 429, 430, 450, 70/452; 292/288, 289, 292, 295, 252, 148, 292/150, 137, 145, 138, 143, 152, 189

See application file for complete search history.

(56) References Cited

U.S. PATENT DOCUMENTS

| | | | | | |
|---|---|---|---|---|---|
| 163,822 | A | * | 5/1875 | Stretcher | 70/429 |
| 1,050,968 | A | * | 1/1913 | McKay | 70/429 |
| 1,055,510 | A | | 3/1913 | Birkle | |
| 1,700,135 | A | | 1/1929 | Lanes | |
| 2,515,364 | A | * | 7/1950 | Weaver | 292/359 |
| 3,263,462 | A | | 8/1966 | Suroff | |
| 3,921,423 | A | | 11/1975 | Hollins | |
| 3,968,985 | A | * | 7/1976 | Nielsen et al. | 292/340 |
| 4,021,063 | A | * | 5/1977 | Porter | 292/67 |
| 4,049,313 | A | * | 9/1977 | Lundberg | 292/307 R |
| 4,064,721 | A | | 12/1977 | Morgan | |
| 4,152,911 | A | | 5/1979 | Sharma | |
| 4,234,220 | A | * | 11/1980 | Finch et al. | 292/148 |
| 4,279,137 | A | * | 7/1981 | Cook | 70/416 |
| 4,673,202 | A | | 6/1987 | Willis | |
| 4,715,200 | A | * | 12/1987 | Katsaros | 70/211 |
| 4,986,096 | A | * | 1/1991 | Soehner et al. | 70/54 |
| 5,193,373 | A | | 3/1993 | Hunt | |
| 5,313,812 | A | | 5/1994 | Eklund | |
| 5,369,971 | A | | 12/1994 | Sheppard | |
| 5,515,704 | A | | 5/1996 | Nguyen | |
| 5,651,279 | A | | 7/1997 | Berton | |
| 5,931,032 | A | * | 8/1999 | Gregory | 70/129 |
| 5,950,465 | A | | 9/1999 | Schultz | |
| 6,301,941 | B1 | | 10/2001 | Nicholsfigueirdo | |
| 6,669,244 | B1 | * | 12/2003 | Bredthauer | E05C 1/04 292/150 |
| 2007/0107479 | A1 | | 5/2007 | Robertson | |
| 2012/0222459 | A1 | * | 9/2012 | Glazar | 70/91 |
| 2012/0248793 | A1 | * | 10/2012 | Fiedler | 292/163 |

* cited by examiner

*Primary Examiner* — Alyson M Merlino
(74) *Attorney, Agent, or Firm* — Young & Thompson

(57) ABSTRACT

A lock consists of an elongated track which is attached to the panel of a door. A slider runs in the track from a retracted position in which the slider is spaced apart from the knob which operates the deadbolt to an engaged position in which the slider is in contact with the knob and prevents it from turning. The slider can be locked in that position by means of a locking pin. The pin may also be used to immobilizes the slider in the retracted position.

3 Claims, 7 Drawing Sheets

DEADBOLT LOCK

This Application claims priority pursuant to 35 USC 119 of Canadian application no. 2,793,264 filed on Oct. 19, 2012 the entire contents of which are hereby incorporated into the following application by reference.

FIELD OF THE INVENTION

This invention relates to a lock for a deadbolt and more particularly to a lock which, when engaged, prevents an unauthorized entry through a door and which can only be engaged or disengaged from within the door but not from outside the door.

BACKGROUND OF THE INVENTION

Deadbolts are engaged by turning a key or knob on the inside of a door and are usually used in conjunction with a lock that engages by the action of a spring. The deadbolt is intended to give an additional measure of protection to occupants of a house or apartment or to their belongings. However, the locks of both a deadbolt and a spring activated lock are subject to being picked. A deadbolt lock, in particular, is usually located in an enclosure on the outside wall of a door or insert into the door and are accessible to be picked by a potential intruder outside the door.

It is known to provide a locking device which prevents the key or knob of a deadbolt from being turned. The devices are positioned on the inside wall of a door and are accessible only to persons inside the door. U.S. Pat. No. 6,301,941 to Nicholsfigueiredo for example describes a bar which slides in a track attached to an inside wall of a door. The bar is in the shape of a yoke which engages the knob of a deadbolt and immobilizes it. The bar only does so however if the track is horizontal. If the bar extends downwardly from the knob, the yoke may slide downward and out of engagement with the knob. If the track extends upwardly from the knob, the yoke may accidently slide downward into engagement with the knob thereby making it impossible to open the door except from inside. If there is no one inside, the door may have to be broken to open it since the door cannot be opened from outside. Even if the track is horizontal the knob must fit into the yoke for the locking device to function properly and if the track shifts over time, the knob may not continue to fit into the yoke.

I have invented a lock for a deadbolt which overcomes many of the shortcomings of the lock described above. The track in which the bar travels may be oriented at any angle on a door so long as the bar when slid forward, contacts the knob. The track can accordingly be positioned so that it avoids decorative moulding or other projections on a door. Furthermore the bar can be immobilized in the track when it is not contacting the knob to prevent the bar from accidently sliding into contact with the knob.

The only way that my lock can be engaged or disengaged is by a person within the premises of a house or apartment. When properly used, the subject lock cannot engage accidently without human intervention and it cannot be engaged or disengaged by someone from outside the premises. As a result, a person cannot accidently lock himself out of a house or apartment since the subject lock can only be engaged and disengaged by him when he is inside the premises.

SUMMARY OF THE INVENTION

Briefly, the lock of my invention includes an elongated track adapted to be attached to the inner panel of a door. A slider is disposed in the track and travels in a direction from an inoperative position in which the slider is spaced apart from the knob which activates a deadbolt to an operative position in which the slider is in contact with the knob mid prevents the knob from rotating. The lock includes immobilizing means for selectively immobilizing the slider in the track when the slider is in the operative and inoperative positions.

DESCRIPTION OF THE DRAWINGS

The lock of the invention is described in detail with reference to the accompanying drawings in which.

DESCRIPTION OF PREFERRED EMBODIMENT

Figure 1:
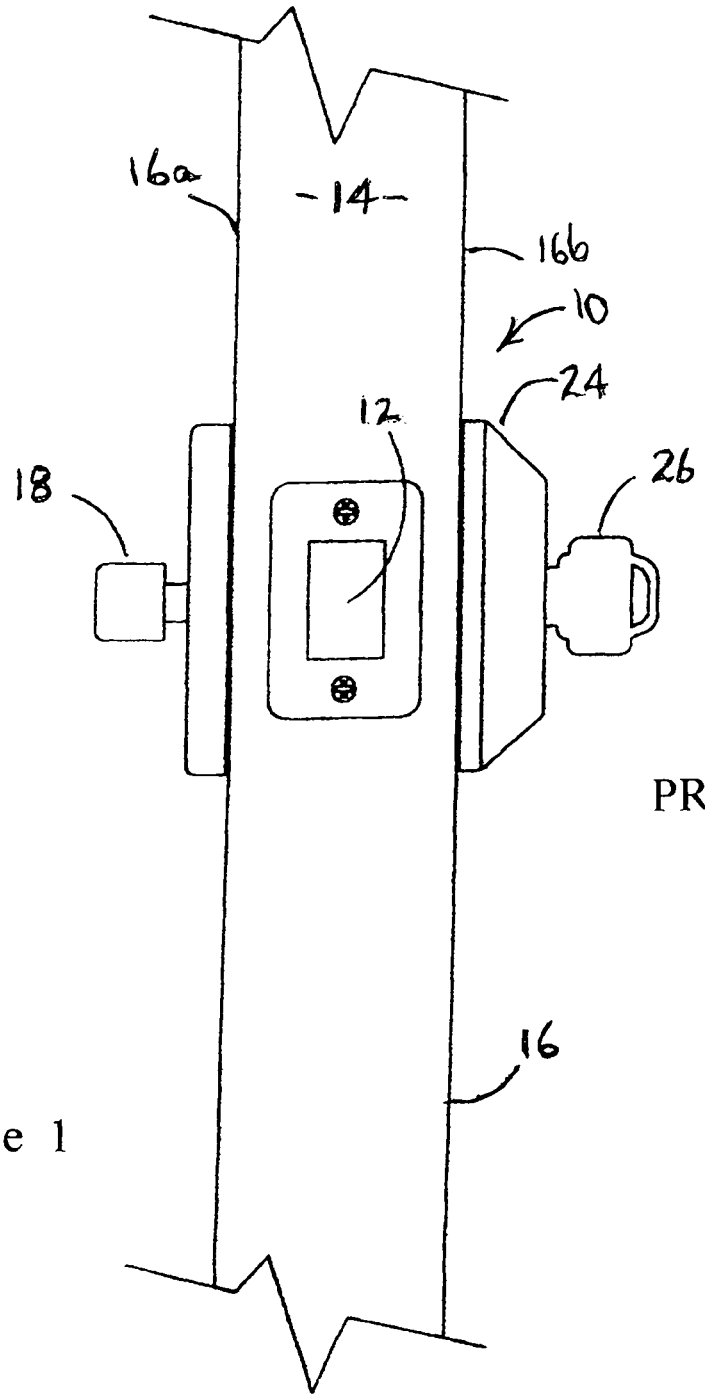
PRIOR ART Figure 1
FIG. 1 is an elevation of the side edge of a door in conjunction with a conventional deadbolt.

With reference to FIG. 1, a conventional deadbolt-lock generally 10 is illustrated. The lock is composed of a deadbolt 12 which extends and retracts from the side edge 14 of a door 16. Knob 18 on the inner panel 16*a* of the door controls the movement of the deadbolt. A mechanism for causing the deadbolt to function is within an enclosure 24 on the outer panel 16*b* of the door and is operated by key 26.

Figure 2A:
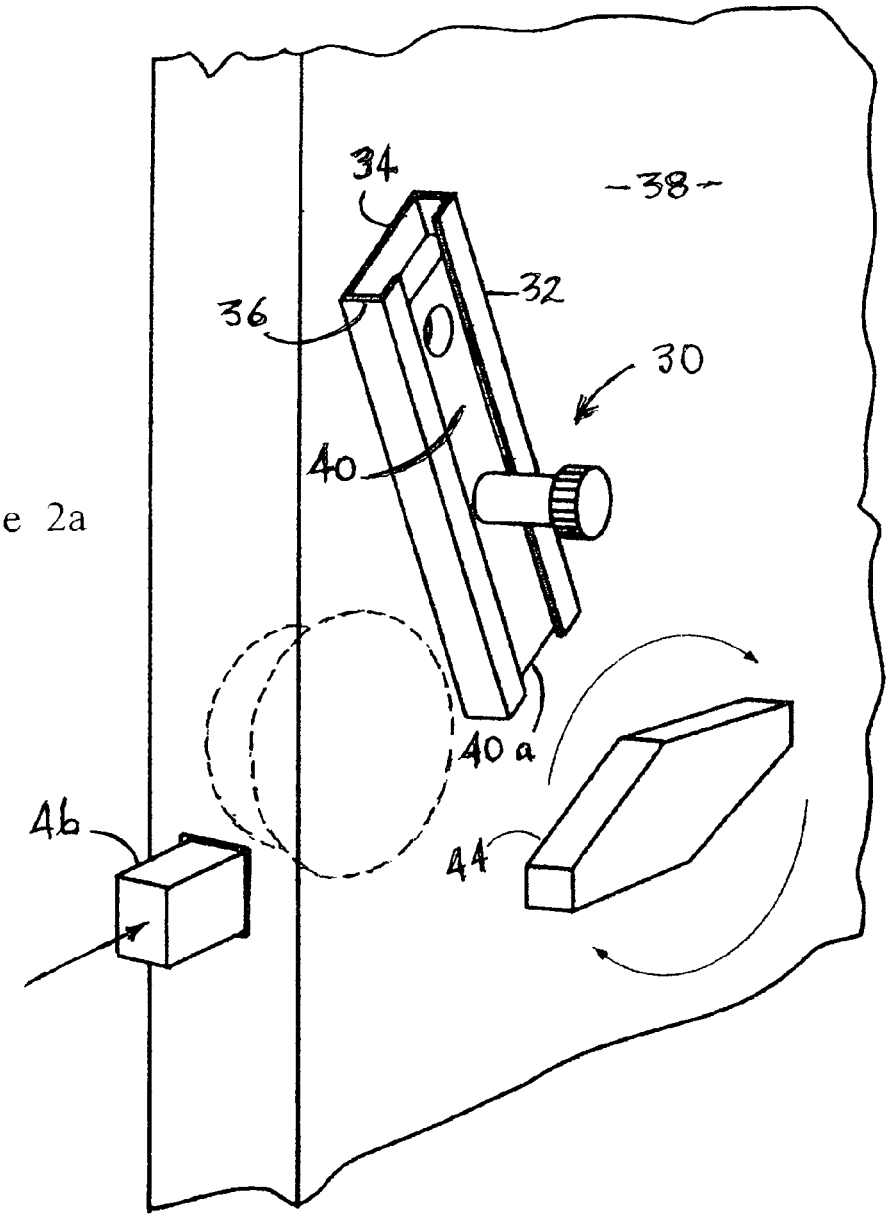
FIGS. 2*a* and 2*b* are perspective views of the lock of my invention arranged above and below, respectively, a knob for operating a deadbolt.
Figure 2B:
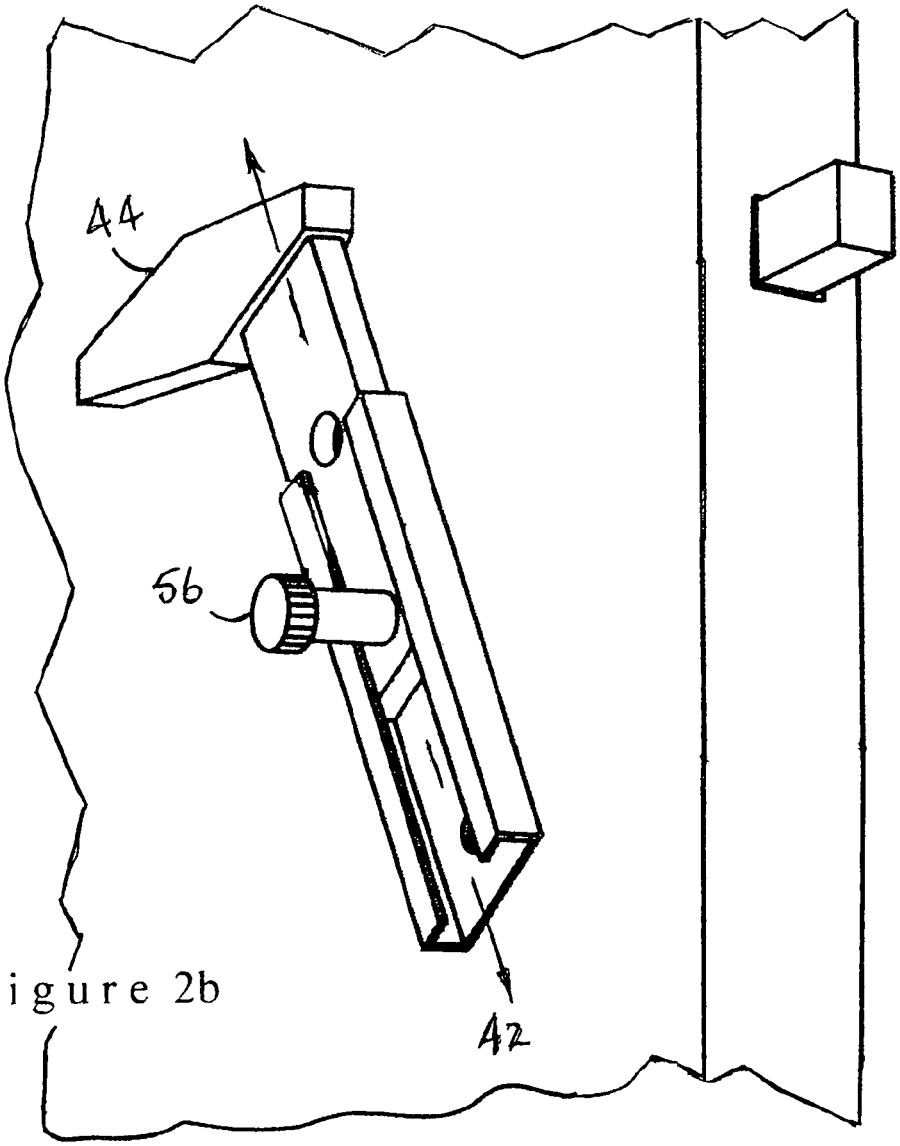

With reference to FIGS. 2*a* and 2*b*, the lock of this invention, generally 30, is composed of a track 32 having a web 34 and U-shaped flanges 36 on opposite sides of the web. The flanges function to confine a slider 40 within the flanges but permit the slider to slide longitudinally in the direction of arrow 42 in the track but not to slide laterally.

The lock is positioned on the inner panel 38 of a door which separates an interior space such as the interior of a house from an exterior space such as the outdoors.

The slider is in the form of a flat bar having a forward or leading edge 40*a* which is relatively straight or flat and is generally perpendicular to the direction of travel 42 of the slider in the track. The track is positioned such that the forward edge of the slider slides toward and away from the knob 44 which controls the movement of a conventional deadbolt 46. The forward edge need not make contact along its entire length with the knob as long as what contact there is, is sufficient to prevent the knob from rotating.

The track may be positioned on the inner panel of the door anywhere around the knob 44: such as above it, as illustrated in FIG. 2*a*, beneath it as illustrated in FIG. 2*b* or horizontally beside it. As long as the position of the track is such that the slider slides toward and away from the knob and the forward edge 44*a* of the slider, in its forward-most position, contacts the knob and immobilizes it, the track is properly positioned.

Figure 3:
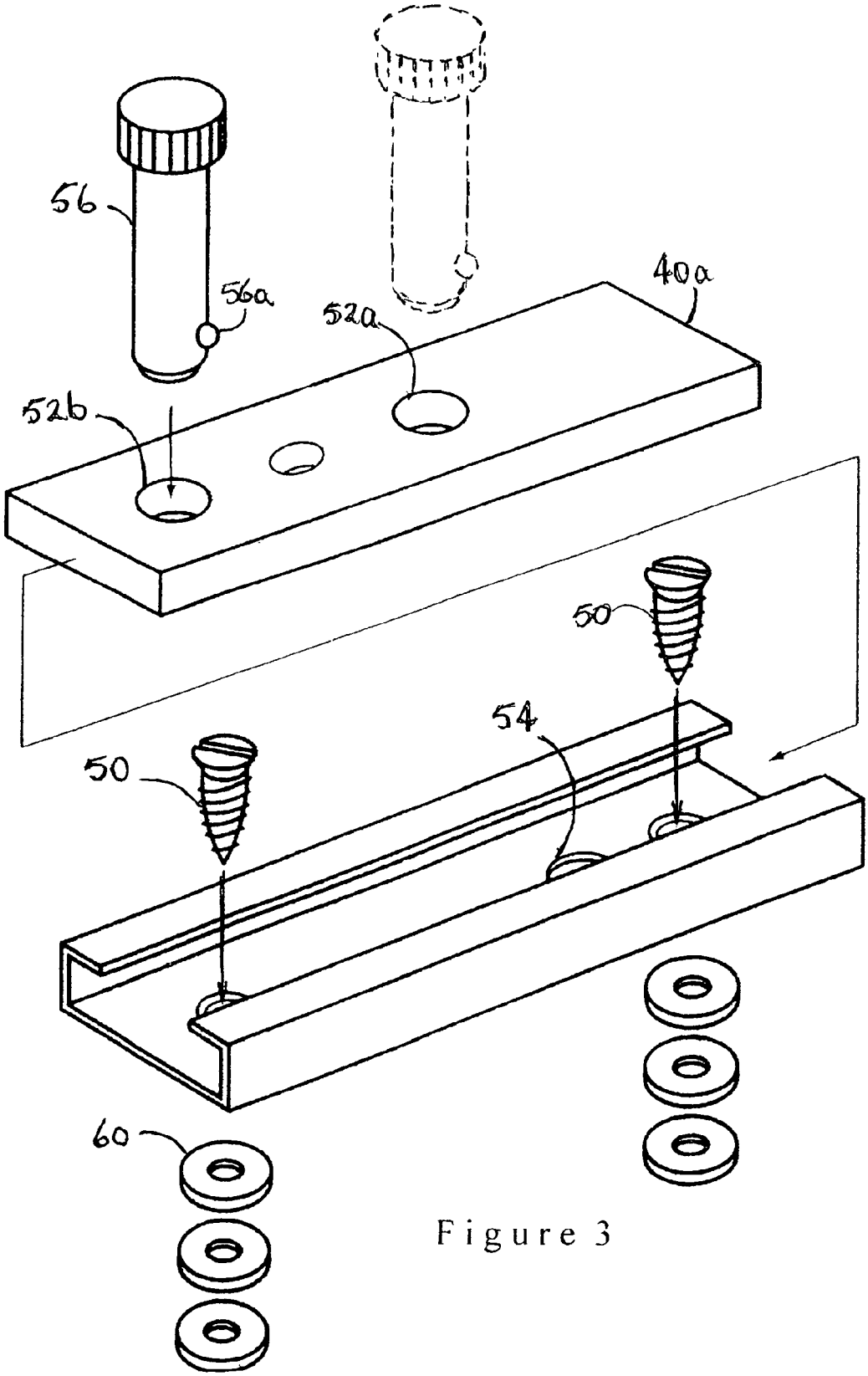
FIG. 3 is an enlarged perspective view of a slider and track of my lock.

With reference to FIG. 3, the track is attached to a door by a pair of screws 50 which extend through apertures in the web of the track and into the inner panel of the door. The slider is provided with two spaced apart openings, a forward opening

52*a* closer to the forward edge 40*a* of the slider and a rear opening 52*b* closer to the rear edge of the slider. The openings are of equal diameter. An opening, 54 also of equal diameter, is formed in the web of the track.

When the forward edge of the slider is in contract with the knob of the deadbolt as illustrated in FIG. 2*b*, the rear opening 52*b* in the slider lines up with opening 54 in the track. When the forward edge of the slider is spaced apart from the knob of the deadbolt, as illustrated in FIG. 2*a*, the forward opening 52*a* in the slider lines up with the opening 54 in the track Immobilizing means in the form of a locking pin 56 serves to immobilize the slider in the track when it is extends through aligned openings in the slider and the track. In FIG. 2*b*, the locking pin immobilizes the slider when it is in contact with the knob of the deadbolt and functions to immobilize the deadlock in an extended position to prevent the door from being opened. The slider is then in an operative position. When the locking pin is removed, the slider may be slid out of contact with the knob. The knob may then be turned to retract the deadbolt into the interior of the door. The slider is then in an inoperative position.

Locking of the knob of the deadbolt is therefore simply a matter of advancing the slider into contact with the knob of the deadbolt and immobilizing the slider hi an operative position by means of the locking pin. Unlocking the knob from an engaged position involves removing the locking pin and withdrawing the slider from the knob until the forward opening in the slider is in alignment with opening 54 in the track. The slider is then in an inoperative or withdrawn position and is im-mobilized in the track in this position by means of the locking pin. The knob may then be turned to retract or advance the deadbolt.

The locking pin may be a simple cylinder or it may be a conventional ball-locking pin having a spring activated ball 56*a* at its lower end as illustrated in FIG. 3. A ball-locking pin is preferred because once inserted into aligned openings in the slider and track, the pin will remain in place unless a force opposed to the bias of the spring is applied to the pin by physically pulling the pin out of the openings. The pin will accordingly not accidentally fall out of the openings.

Figure 4:
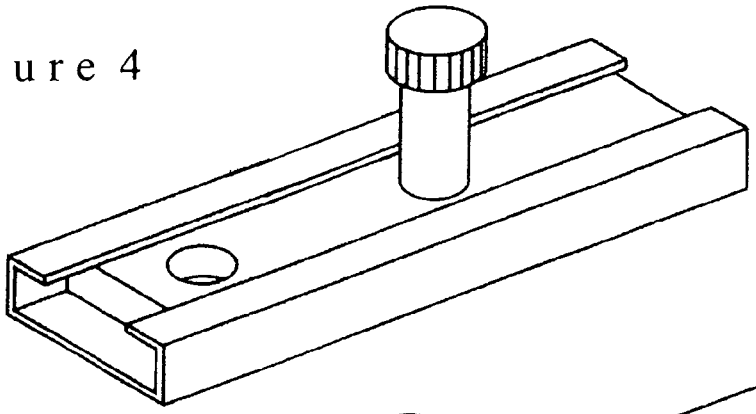
FIGS. 4 and 5 are perspective views of the slider in a withdrawn and an extended position, respectively within the track.
Figure 5:
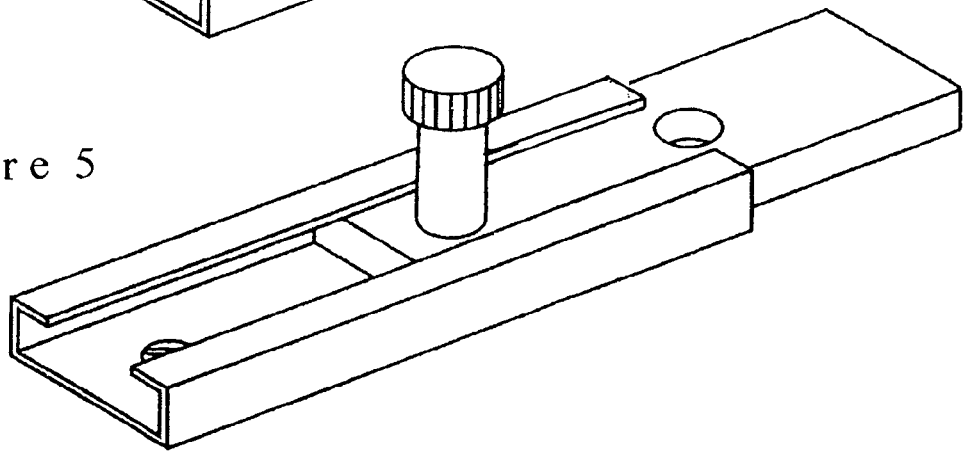

In FIG. 4 the slider is in an inoperative or withdrawn position and in FIG. 5, the slider is in an operative or extended position.

As previously indicated, the only way that the subject lock can be engaged or disengaged is by a person within the premises of a house or apartment. The subject lock cannot engage without human intervention except in one situation. If the lock is above the knob of a deadbolt and the slider is not immobilized by a locking pin, the slider may slide downward into engagement with the knob. In that case, the knob can still be turned by means of a key from outside the door. That is because if there is no locking pin to prevent the slider from moving, the knob will cause the slider to move upward so that it dues nut hinder its rotation.

Except in the above situation, the deadbolt cannot be engaged or disengaged by someone from outside the premises. As a result, a person cannot accidently lock himself out of a house or apartment since the subject lock can only be engaged and disengaged by him when he is inside the premises.

Figure 6:
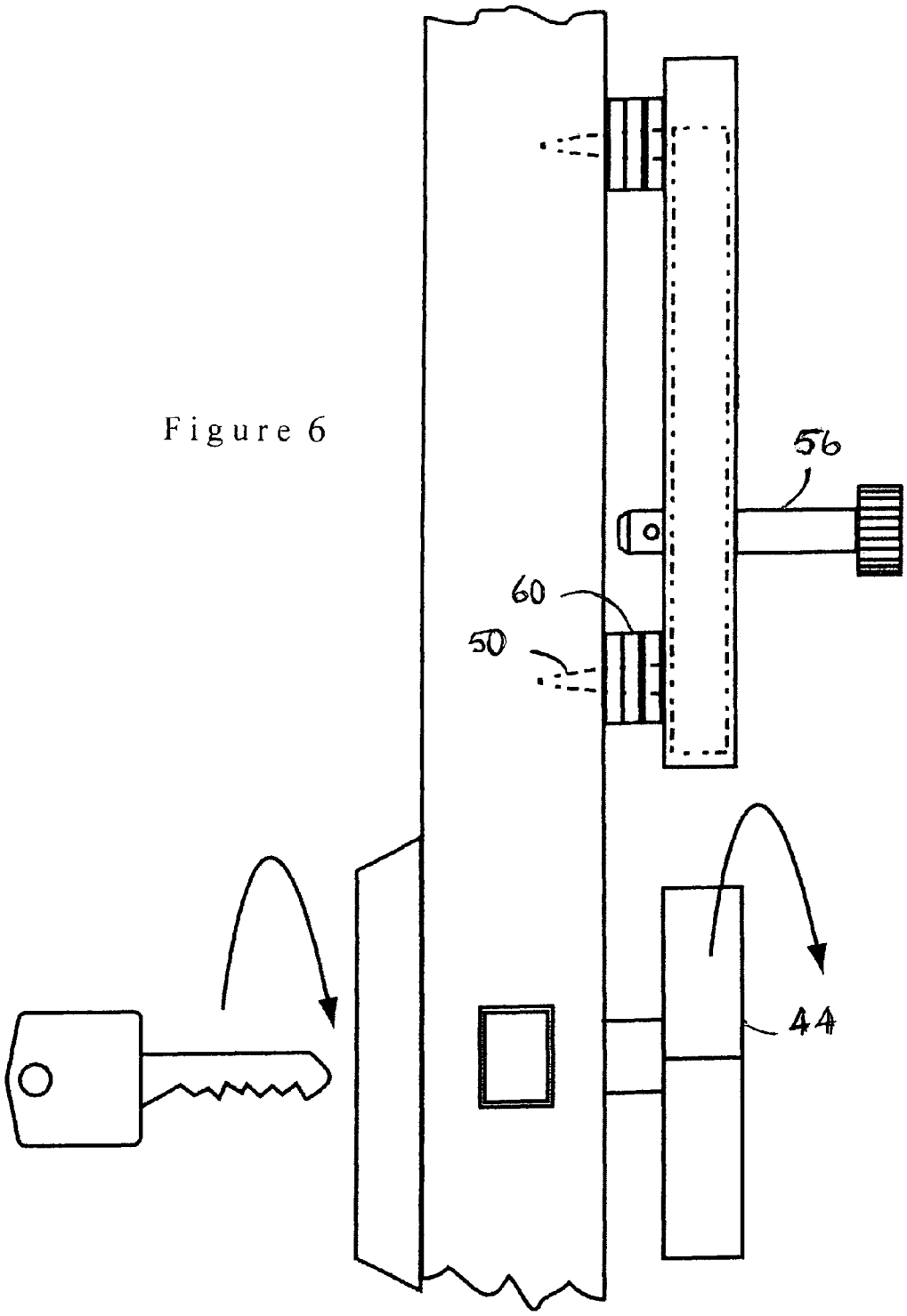
FIG. 6 is an elevation of my lock in which the knob of a deadlock is free to turn.
Figure 7:
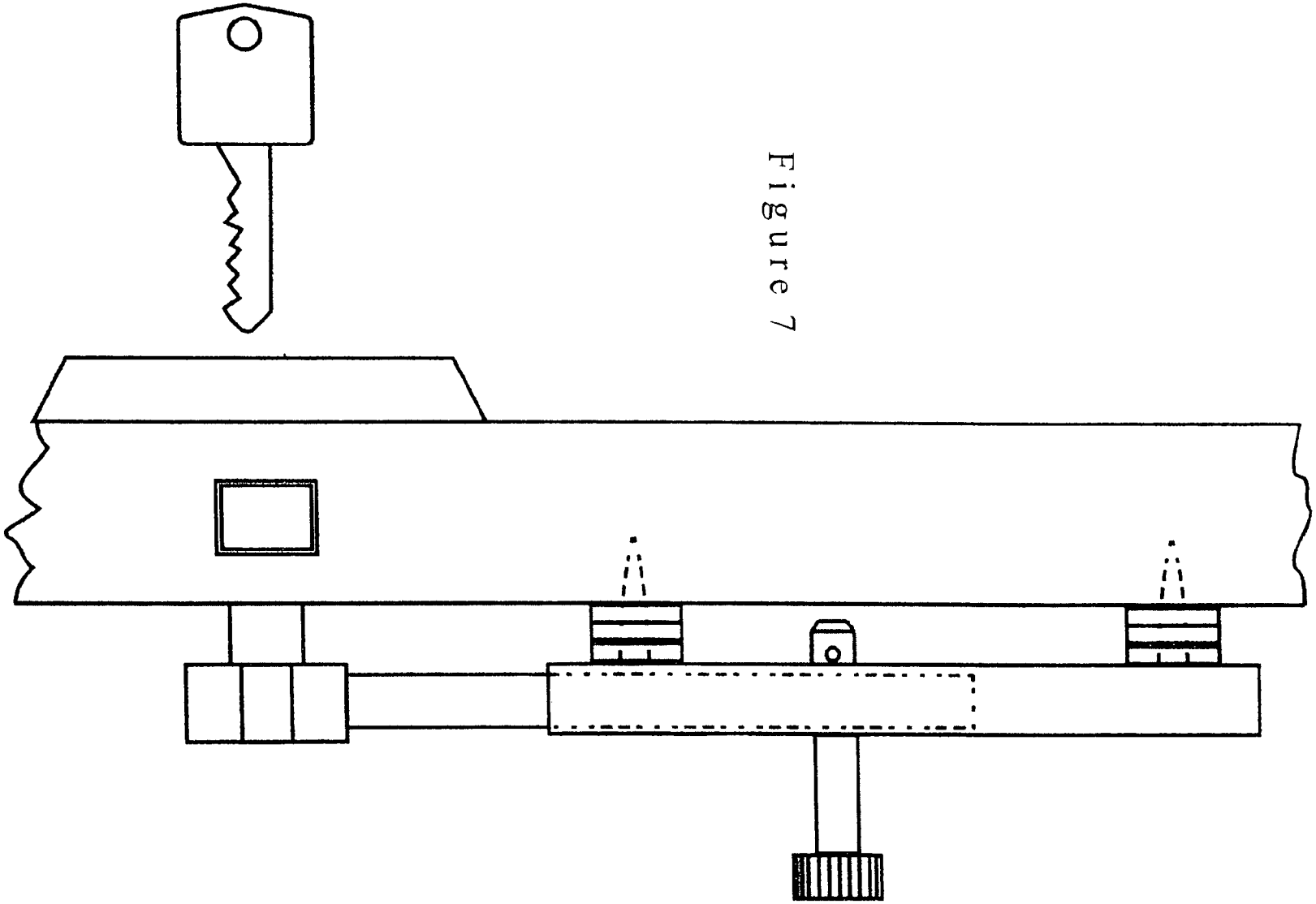
FIG. 7 is an elevation of my lock in which the knob of a deadlock is prevented from turning Like reference characters refer to like parts throughout the description of the drawings

With reference to FIGS. 3, 6 and 7, the spacing between the track and the door can be adjusted by means of one or more washers 60 surrounding screws 50 which attach the track to a door. The screws allow the position of the slider to be adjusted to contact the knob of the deadbolt whether the knob is adjacent to the door or spaced apart from it. The washers also make it possible to position the track sufficiently far apart from the door to ensure that them is sufficient clearance for the spring loaded ball 56*a* of the locking pin to function.

It will be understood, of course, that modifications can be made in the lock of the invention without departing from the scope of the invention defined in the appended claims.

I claim:

1. A lock configured for installation on a door which separates an interior space from an exterior space, the door having oppositely facing inner and outer panels, the inner panel, when the door is closed, faces the interior space while the outer panel faces the exterior space, said lock cooperating with a deadbolt operable by a knob accessible in the interior space and by a key, accessible in the exterior space, wherein with said deadbolt installed in the door, said deadbolt is caused to selectively lock and unlock the door from the interior space by operation of the knob accessible in the interior space and from the exterior space by operation of the key accessible in the exterior space, wherein the lock comprises: an elongated track adapted to be attached to the inner panel of the door and comprising an underside surface facing the inner panel of the door when the track is attached to the inner panel, a slider disposed in said track, said slider having a flat leading edge, said slider being slidable from i) an inoperative position in which said slider is spaced apart the knob and allows the knob to turn, to ii) an operative position in which said leading edge is in contact with a corresponding surface of the knob and prevents the knob from turning; and immobilizing means for selectively immobilizing said slider in said operative position and in said inoperative position, wherein said immobilizing means is a spring-activated ball-locking pin comprising a spring and a ball, wherein when inserted into openings of said track and said slider corresponding to said operative position and said inoperative position of said slider, the pin holds the slider in place in the track by engagement of said ball with the underside surface of the track until a force, opposed to the bias of said spring, is applied to extract said pin from said openings, allowing the slider to be slid in the track, and wherein said slider comprises a flat bar having the flat leading edge that is generally perpendicular to the directions in which said slider slides in said track.

2. The lock of claim 1, further including adjusting means for adjusting the spacing of said track from the inner panel.

3. The lock of claim 2, wherein said adjusting means is one or more washers adapted to be positioned between said track and the inner panel.

* * * * *